US009220960B2

(12) United States Patent
Schartiger et al.

(10) Patent No.: US 9,220,960 B2
(45) Date of Patent: Dec. 29, 2015

(54) PUTTER HEAD, ADJUSTABLE SHAFT AND PUTTER

(71) Applicant: Taylor Made Golf Company, Inc., Carlsbad, CA (US)

(72) Inventors: Chris Schartiger, San Diego, CA (US); Peter L. Larsen, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 227 days.

(21) Appl. No.: 13/723,122

(22) Filed: Dec. 20, 2012

(65) Prior Publication Data

US 2014/0179459 A1 Jun. 26, 2014

(51) Int. Cl.

| | |
|---|---|
| ***A63B 53/02*** | (2015.01) |
| ***A63B 53/04*** | (2015.01) |
| ***A63B 53/06*** | (2015.01) |
| ***A63B 53/10*** | (2015.01) |
| ***A63B 53/16*** | (2006.01) |
| ***A63B 53/00*** | (2015.01) |
| *A63B 49/06* | (2006.01) |
| *A63B 59/00* | (2015.01) |

(52) U.S. Cl.

CPC ..... *A63B 53/10* (2013.01); *A63B 53/007* (2013.01); *A63B 53/0487* (2013.01); *A63B 49/06* (2013.01); *A63B 53/02* (2013.01); *A63B 2053/0408* (2013.01); *A63B 2053/0416* (2013.01); *A63B 2053/0433* (2013.01); *A63B 2053/0437* (2013.01); *A63B 2053/0491* (2013.01); *A63B 2059/0003* (2013.01); *A63B 2059/0085* (2013.01)

(58) Field of Classification Search

CPC ..... A63B 53/007; A63B 53/0487; A63B 2053/0416; A63B 53/02; A63B 2059/0085; A63B 2053/0408; A63B 2059/0003; A63B 53/10; A63B 49/06; A63B 2053/0437; A63B 2053/0433; A63B 2053/0491

USPC ..... 473/324–350, 251–256, 313–314, 296, 473/298, 300; D21/736–746

See application file for complete search history.

(56) References Cited

U.S. PATENT DOCUMENTS

| | | | | |
|---|---|---|---|---|
| 5,820,481 | A * | 10/1998 | Raudman | 473/313 |
| 6,974,394 | B1 * | 12/2005 | Tang et al. | 473/335 |
| 7,048,646 | B2 * | 5/2006 | Yamanaka et al. | 473/332 |
| 7,074,135 | B2 | 7/2006 | Moore | |
| 7,160,203 | B2 * | 1/2007 | Bonneau | 473/334 |
| 7,351,162 | B2 * | 4/2008 | Soracco et al. | 473/335 |
| 7,431,660 | B2 * | 10/2008 | Hasegawa | 473/251 |
| 7,438,496 | B2 | 10/2008 | Moore | |
| 7,491,131 | B2 * | 2/2009 | Vinton | 473/251 |
| 7,601,076 | B2 * | 10/2009 | Rollinson | 473/288 |
| 7,993,217 | B2 * | 8/2011 | Cameron | 473/340 |
| 8,066,581 | B2 | 11/2011 | Ines et al. | |
| 8,192,305 | B2 | 6/2012 | Nishino | |
| 8,205,308 | B2 | 6/2012 | Moore | |
| 8,328,654 | B2 * | 12/2012 | Demkowski et al. | 473/248 |
| 8,382,604 | B2 * | 2/2013 | Billings | 473/244 |
| 2004/0198529 | A1 | 10/2004 | Moore | |
| 2010/0184527 | A1 | 7/2010 | Demkowski et al. | |

* cited by examiner

*Primary Examiner* — Sebastiano Passaniti

(74) *Attorney, Agent, or Firm* — Klarquist Sparkman, LLP

(57) ABSTRACT

A golf club head comprises a front portion, a rear portion, a toe portion and a heel portion that together form a two-piece body and for which a center of gravity is defined. The body comprises a central portion as a first piece and a frame as a second piece. The frame encloses a substantial portion of the central portion within an XY-plane. The central portion is connected with the frame with fasteners along at least the front portion. The moment inertia of the club head about a z-axis of the center of gravity is between about 7,000 g·cm$^2$ and about 14,000 g·cm$^2$.

20 Claims, 16 Drawing Sheets

PUTTER HEAD, ADJUSTABLE SHAFT AND PUTTER

FIELD

This application relates to golf equipment, and more particularly to putter heads, adjustable shafts usable with putter heads and putters having adjustable shafts.

BACKGROUND

Golf is a game in which a player, choosing from a variety of different golf clubs, seeks to hit a ball into each hole or cup on the golf course in the fewest possible strokes. When a golf club contacts a golf ball off-center, the golf club head can twist about its center of gravity and cause the golf ball to travel in an unintended direction. In addition, twisting of the golf club head can cause the ball to skid across a surface rather than roll forward in a smooth manner.

A putter is one type of golf club, and is designed for use on a putting green for shots that close to the hole or cup. Putters are used when a great deal of accuracy and precision are required. Putters are available in different types, including long or broomstick putters having the greatest length (typically 48-52 inches), belly putters designed to be anchored against the golfer's belly (typically 41-44 inches) and conventional putters (typically 32-36 inches).

SUMMARY

Described below are embodiments of a golf club head, an adjustable golf club shaft assembly and an adjustable golf club that address shortcomings of the prior art.

According to a first implementation a golf club head comprises a front portion, a rear portion, a toe portion and a heel portion together forming a two-piece body and for which a center of gravity is defined. The body comprises a central portion as a first piece, and a frame as a second piece. The frame encloses a substantial portion of the central portion within an XY-plane. The central portion is connected with the frame with fasteners along at least the front portion. The moment of inertia of the club head about a z-axis of the center of gravity is between about 7,000 $g \cdot cm^2$ and about 14,000 $g \cdot cm^2$.

In some implementations, the moment of inertia of the club head about the z-axis of the center of gravity between about 7,000 $g \cdot cm^2$ and about 10,000 $g \cdot cm^2$. In other implementations, the moment of inertia of the club head about the z-axis of the center of gravity between about 7,000 $g \cdot cm^2$ and about 9,500 $g \cdot cm^2$. Further, some implementations of the club head have a moment of inertia about the z-axis of the center of gravity between about 8,200 $g \cdot cm^2$ and about 9,500 $g \cdot cm^2$.

The golf club head can comprise a sole plate located within the central portion and attached to the central portion with fasteners. The sole plate can be comprised of an injection molded material. The sole plate can comprise a centrally located opening shaped to receive a weight threadedly connectable to the central portion.

The fasteners attaching the central portion to the frame along the front portion can extend in a first direction, and there can be fasteners extending in a second direction adjacent a rear of the frame attaching the central portion to the frame.

The golf club head can comprise a hosel extending from the body and a length-adjustable shaft connected to the hosel.

An adjustable golf club shaft assembly for connection to a golf club head can comprise a lower shaft section, an upper shaft section, a deformable retainer and a clamp. The lower shaft section has a first end for connection to the golf club head and an opposite second end. The upper shaft section is dimensioned to telescopingly receive the second end of the lower shaft section. The deformable container is connected to the second end of the lower shaft section. The claim is positionable at the intersection of the upper shaft section and the lower shaft section. The clamp is adjustable to secure the upper shaft and the lower shaft sections together to achieve a selected overall shaft length. The retainer is configured to contact an inner surface of the upper shaft section to prevent the lower shaft section and the upper shaft section from inadvertent disassembly if the clamp is in a loosened state.

The golf club shaft assembly can comprise a bushing inserted in the upper shaft section and through which the lower shaft section is received. The bushing and the clamp can have mating engagement surfaces to position the clamp relative to the bushing and the shaft sections. The engagement surfaces can include a circumferential rib on the bushing and a circumferential groove on the clamp dimensioned to receive the circumferential rib. The engagement surfaces can include an axial rib on the bushing and an axial groove on the clamp dimensioned to receive the axial rib.

The clamp can be annular-shaped and can comprise an axially-extending gap and a threaded aperture on one side of the gap. A threaded tool can be rotated into contact with a surface on an opposite side of the gap to widen the gap and loosen the clamp from its self-locking state. The threaded aperture can have a left-hand thread.

The golf club shaft assembly can comprise a guide plug dimensioned for insertion into the lower shaft section and having a protruding section that comprises the retainer. The retainer can comprise resiliently deformable ears shaped to bend and guide the lower shaft section upon its insertion through the bushing and into the upper shaft section. In some implementations, the lower shaft section cannot be withdrawn from the upper shaft section without permanently deforming the retainer.

The clamp can be self-locking and formed of a heat treated stainless steel selected to apply a desired clamping force to the bushing and the lower shaft when the clamp is at rest. The heat treated stainless steel material can comprise 17-4 steel subjected to a H900 heat treatment and having a hardness of HRC 42-46. According to one implementation, an adjustable golf club comprises the two-piece body of the central portion and the frame as described above, a telescoping shaft connected to the frame, the shaft is adjustable in length, and a grip attached to the shaft. The moment of inertia about a z-axis of the center of gravity can be between about 7,000 $g \cdot cm^2$ and about 14,000 $g \cdot cm^2$.

The foregoing and other objects, features, and advantages of the invention will become more apparent from the following detailed description, which proceeds with reference to the accompanying figures.

DETAILED DESCRIPTION

Figure 1A:
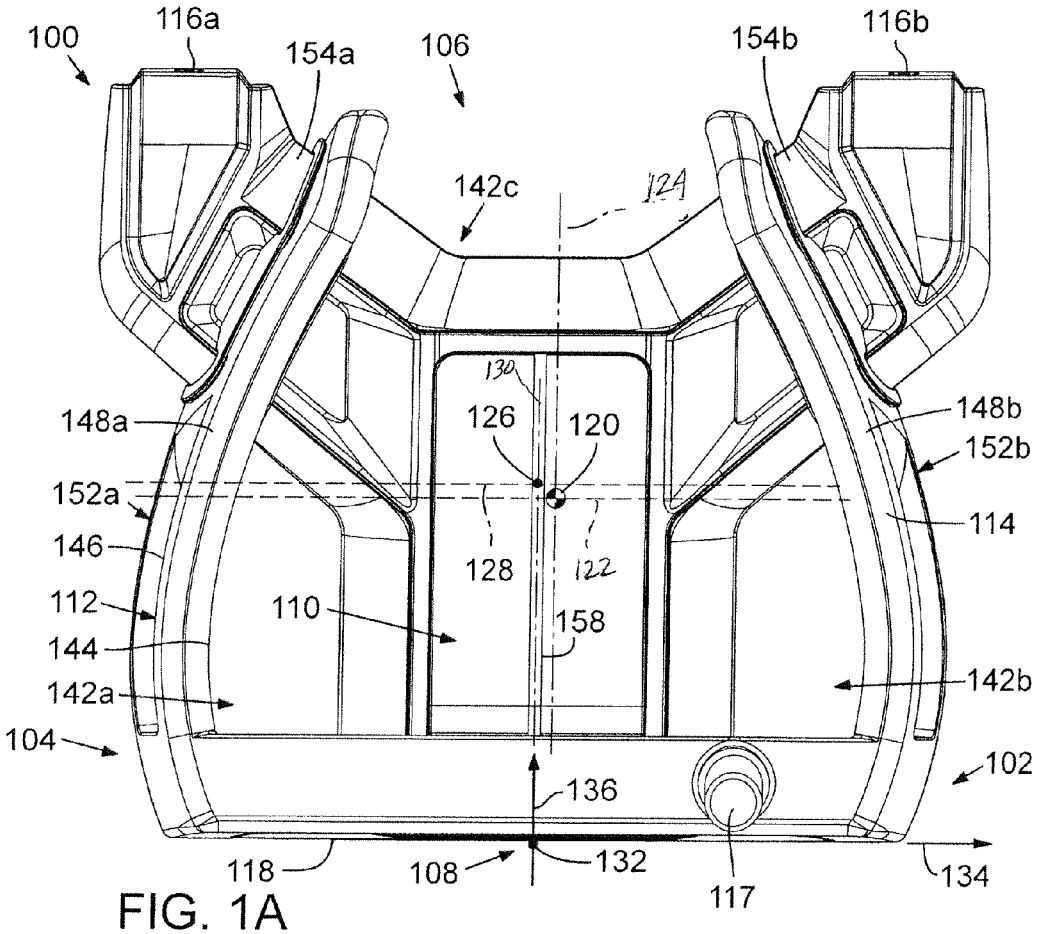
FIGS. 1A, 1B, 1C and 1D are top plan, side elevation, front elevation and bottom plan views, respectively, of a representative golf club head.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Certain terms will be used to address certain sections of the golf club head. For instance, the "heel" of a golf club head generally refers to the section of the golf club head that is closest to a player when the player is addressing the golf club head in a normal playing stance. The "toe" of a golf club head generally refers to the section of the golf club head that is furthest from a player when the player is addressing the golf club head in a normal playing stance. Furthermore, the "front" of the golf club head generally refers to the portion of the golf club head directly adjacent to the striking face of the club had, and the "rear" of the golf club head generally refers to the portion of the club head furthest from the striking face of the club head.

A putter-type golf club twists when striking a golf ball at an off-center portion of the putter head. As the putter head twists around a vertical axis during impact with a golf ball, the golf ball is more likely to travel in a direction other than the direction intended by the golf player. Similarly, as the putter head twists around a horizontal axis upon impact with a golf ball, the golf ball is more likely to skip over the putting green rather than roll smoothly in a straight direction.

When a golf club head twists due to an off-center hit, it twists about an axis that goes through the center of gravity (CG) of the golf club head. In general, a higher moment of inertia (MOI) decreases the amount that a golf club head will twist when a force is applied during a golf stroke. A moment of inertia about an X-axis is defined as $I_{xx}$. The $I_{xx}$ is the moment of inertia about a horizontal axis that runs from the toe to the heel of the golf club and through the CG of the club head. A large $I_{xx}$ prevents the golf club head from tilting about the horizontal X-axis during an off-center hit.

The moment of inertia about the golf club head CG X-axis is calculated by the following equation:

$$I_{CG_x}=\int(y^2+z^2)dm$$

Furthermore, the $I_{zz}$ is the moment of inertia about the Z-axis which is a vertical axis that extends at least from the top of the golf club head to the bottom of the golf club head and through the CG of the golf club head. An increase in $I_{zz}$ decreases the amount the putter head twists with respect to the center line or path of the golf club swing during an off-center hit impacting the club face in a region closer to the heel or toe rather than the center face.

By increasing the amount of mass located in the outer sections of the putter head, the $I_{zz}$ is substantially increased. Mass arrangements according to this disclosure have provided a putter head with an $I_{zz}$ of greater than about 4000 $g\cdot cm^2$ and, in some embodiments, up to 14,000 $g\cdot cm^2$. More particularly, specific implementations of a putter head with an $I_{zz}$ of greater than about 7000 $g\cdot cm^2$ up to about 10,000 $g\cdot cm^2$ are achievable. Even more particularly, specific implementations of a putter head with an $I_{zz}$ of greater than about 9500 $g\cdot cm^2$ up to about 8800 $g\cdot cm^2$ are achievable.

A moment of inertia about the golf club head CG Z-axis is calculated by the following equation:

$$I_{CG_z}=\cdot(x^2+y^2)dm$$

FIG. 1A illustrates a top view of an embodiment of a putter head 100 including a heel side 102, a toe side 104, a rear portion 106, and a front portion 108. The putter head 100 further includes a central portion 110 and a frame 112. Considering the major components of the central portion 110 and the frame 112, the putter head 100 can be described as having a two-piece body. The frame 112 includes a rim 114 having respective toe and heel portions 152*a*, 152*b*, an open back portion between rear ends of the rim portions 152*a*, 152*b*, a face portion 118 and a hosel 117.

In one embodiment, the club head has a general maximum width dimension (parallel to the X-axis) of about 117.5 mm, a maximum length dimension (parallel to the Y-axis) of about 102.5 mm, and a height dimension (parallel to the Z-axis) of about 23.9 mm. It is understood that these dimensions can be varied to any value in accordance with the Rules of Golf as approved by the United States Golf Association (herein, "USGA").

FIG. 1A further shows that the frame 112 is positioned outwardly of the central portion 110 within an X-Y plane on three sides. Thus, the frame encloses the central portion 110 except for a rear side of the central portion. That is, the heel portion 152*b* of the frame 112 is positioned outwardly in the XY plane of a heel side of the central portion 110. The face portion 118 of the frame 112 is positioned outwardly in the XY plane of a face side of the central portion 110. The toe portion 152*a* of the frame is positioned outwardly in the XY plane of a toe side of the central portion 110.

Two gaps 142*a*, 142*b* are located between the central portion 110 and the frame 112. Specifically, a toe gap 142*a* is located on the toe side 104 whereas a heel gap 142*b* is located on a heel side 102 of the club head 100. There is a rear setback area 142*c* defined between a rear side of the central portion and rear ends of the rim portions 152*a*, 152*b*.

In addition, FIG. 1A shows the rim 114 having an inner peripheral contour 144 and an outer peripheral contour 146 defining a respective inner surface and outer surface. In one embodiment, the inner 144 and outer 146 peripheral contours define a kettle or truncated bulb shape in plan. Furthermore, the rim 114 is shown to be extending away from the face portion 118 and such that the contours 144,146 flare outwardly from the face portion 118. In other words, two side portions 148*a*, 148*b* of the rim 114 initially diverge from one another adjacent the face portion 118 as they extend toward the rear of the club head 100.

The central portion 110 includes a pair of laterally outboard weighted portions, including a heel-side weighted portion 116*b* and a toe-side weighted portion 116*a*. The weighted portions 116*a*, 116*b* can be accessed to allow any weights housed therein to be removed or changed in mass as necessary to adjust the feel and/or trajectory of the club head. Exemplary weights can be formed of a tungsten alloy or any other suitable material described herein, as is described in greater detail below.

In addition, adjacent the weighted portions 116*a*, 116*b* are respective thickened flange portions 154*a*, 154*b*. In the illustrated embodiments, the weighted portions 116*a*, 116*b* have a streamlined shape, although any other suitable shape is also possible. FIG. 1A shows the flange portions 154*a*, 154*b* and weighted portions 116*a*, 116*b* extending beyond the outer peripheral contour of the rim 114.

The golf club head 100 may have one or more alignment indicia, such as the line 158, that a golfer may use to align the ball with the center of the club head 100.

A center of gravity (CG) is defined for the putter head 100 at 120. The CG 120 establishes the origin for a CG X-axis 122, a CG Z-axis 123 and a CG Y-axis 124. The CG Y-axis 124 extends along the length of the putter from a rear to front direction and passes through the CG 120. In addition, the CG X-axis extends along the width of the putter head from a heel to toe direction and passes through the CG 120. The CG Z-axis extends in a vertical direction along the height of the putter head 100 between a bottom and top portion. As shown in FIG. 1A, the CG 120 is located forward of the geometric center point 126 having a horizontal dashed center X-axis 128 separating the front portion 108 from the rear portion 106. The geometric center point 126 also defines a horizontal dashed center Y-axis 130 separating the heel side 102 from the toe side 104. It is understood that the CG 120 location can coincide with the geometric center point 126 or can be located away from the geometric center point 126.

Figure 1B:
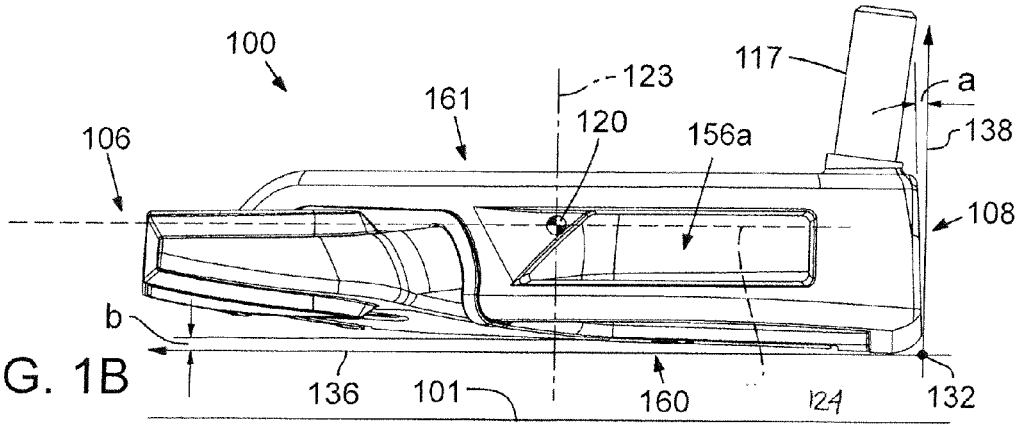

Furthermore, FIGS. 1A and 1B show a ground center location 132 (located near a bottom edge of the face) having a ground center X-axis 134, a ground center Y-axis 136, and ground center Z-axis 138. The ground center location 132 is located at the center of the width of the putter face insert 140 and at the intersection of the face portion 118 plane (a plane containing the face) and a sole portion 160 plane (a horizontal ground plane tangent to the lowest point of the club head). The CG 120 location of the putter head 100 is measured from the ground center location 132. In one embodiment, the CG location includes a CGx of about 0.6 mm (toward the heel), a CGy of about 40.4 mm and a CGz of about 13.4 mm.

In one embodiment, the club head 100 has an $I_{xx}$ value of about 4180 g·cm$^2$ and an $I_{zz}$ value of about 8450 g·cm$^2$. The unique construction and configuration of the described elements described herein enable the above moment of inertia values to be achieved. A large CGy value will promote more forward roll or spin upon impact with the golf ball. In addition, a higher moment of inertia will produce less twisting of the club head upon impact.

In certain embodiments, the central portion 110 is comprised of an aluminum hollow body having a mass, including weights, of about 158.9 g (FIGS. 1A-1E) or 169.7 g (FIGS. 2A-2E). In addition, the frame 112 is a steel frame having a mass of about 206 g (FIGS. 1A-1E) or 221 g (FIGS. 2A-2E). Upon assembly, the total assembled mass of the club head including gaskets and weights is about 395 g to about 445 g. It should be noted that this total assembled mass range also accounts for the variable weight 176 described below, which can ran range from 2.5 g to 25 g in the described implementations. The "two-piece" construction of an aluminum central portion 110 and a steel frame 112 permits a more rearward CG location and higher moment inertia to be achieved.

In the illustrated embodiments, the club head 100 and the club head 200 have a head loft angle a of about 2.5 degrees (measured relative to ground position) as shown in FIG. 1B. A second angle, i.e., a bounce angle b, is measured as shown between a bottom of the club head and the ground surface when the shaft is in a vertical position. It is noted that although the hosel 117 is angled, the shaft that is attached to the hosel has a bend to position the shaft vertically when the head is positioned as shown in FIG. 1B.

The side portions 148*a*, 148*b* include a slotted region 156*a*, 156*b* creating a through hole or through slot on each side portion 148*a*, 148*b*. In addition, FIG. 1B also shows a back portion 106 having a portion of the sole 160 that is angled away from a ground surface 101 and tapers toward the top portion 161.

Figure 1C:
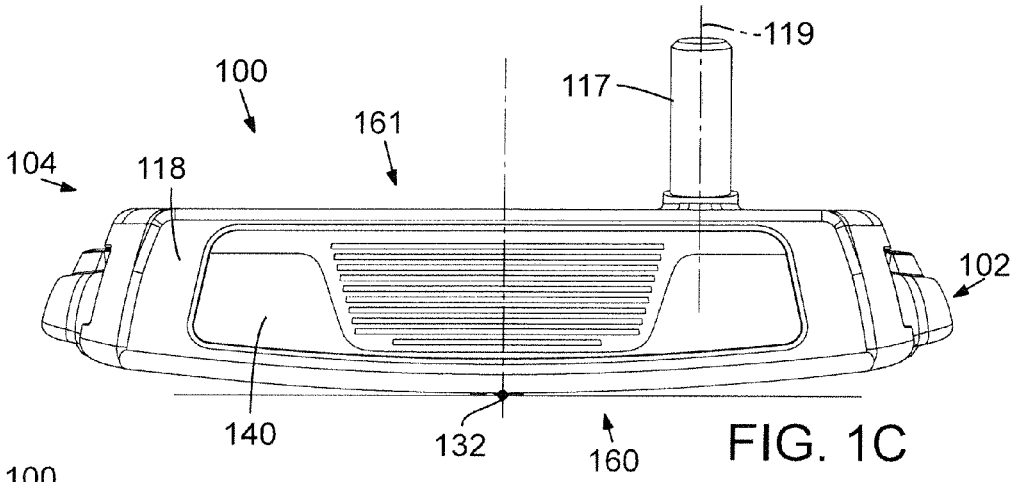

FIG. 1C further shows a face insert 140 that is included in the face portion 118. Located underneath the face insert 140 on a face insert mounting surface are two countersink or counterbore holes configured to receive two fastening mechanisms to secure a front portion of the central portion 110 to the frame 112 (as shown in other embodiments described herein).

The face insert can include grooves for promoting forward roll as described in U.S. Pat. No. 7,278,926, No. 7,465,240 and No. 8,328,654, which are incorporated by reference in their entirety. The face insert 140 can also be made of various materials, such as aluminum or a polymer material, as described in further detail below.

Figure 1D:
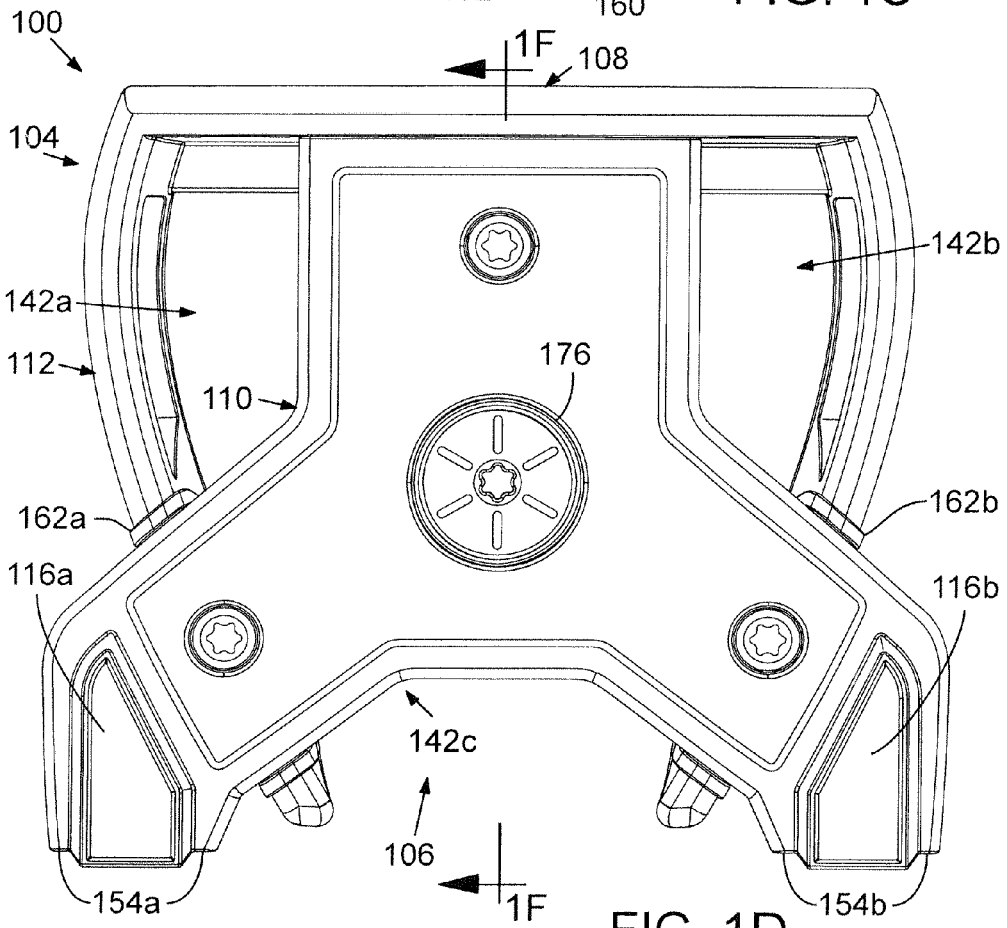

FIG. 1D illustrates a bottom view of the putter head 100 including the sole portion 160 having a gasket material 162*a*, 162*b* between the central portion 110 and the frame 112. In one embodiment, the gasket material 162*a*, 162*b* extends along the entire engagement surface between the central portion 110 and the frame 112 in order to provide a tighter fit and prevent damage or unwanted sound or vibration during use. In other words, the gasket material isolates the central portion 110 from the frame 112.

Figure 1E:
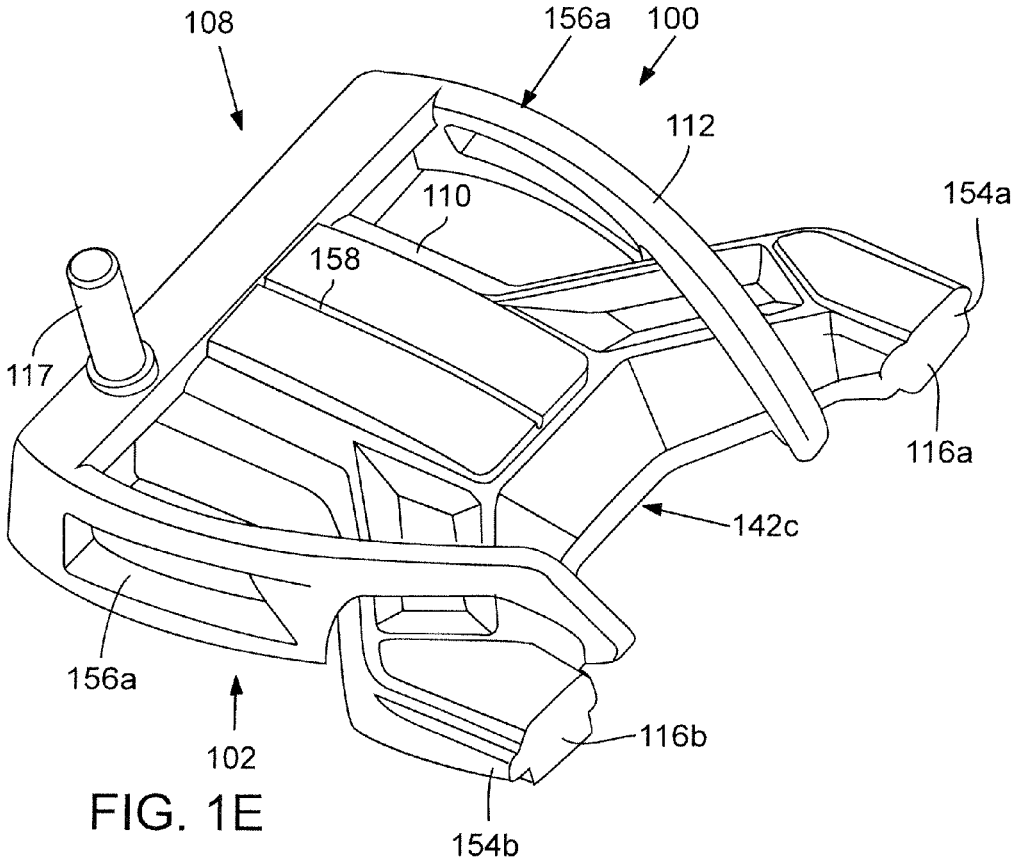
FIG. 1E is a perspective view of the representative golf club head of FIGS. 1A-1D.

FIG. 1E illustrates an isometric view of the putter head 100 showing a decreasing overall thickness of the central portion 110 in the Y-direction (excluding the weight ports). The central portion 110 primarily attaches near the face portion 118 and at the central portion 110 and frame 112 intersection in the gasket material regions described above.

Figure 1F:
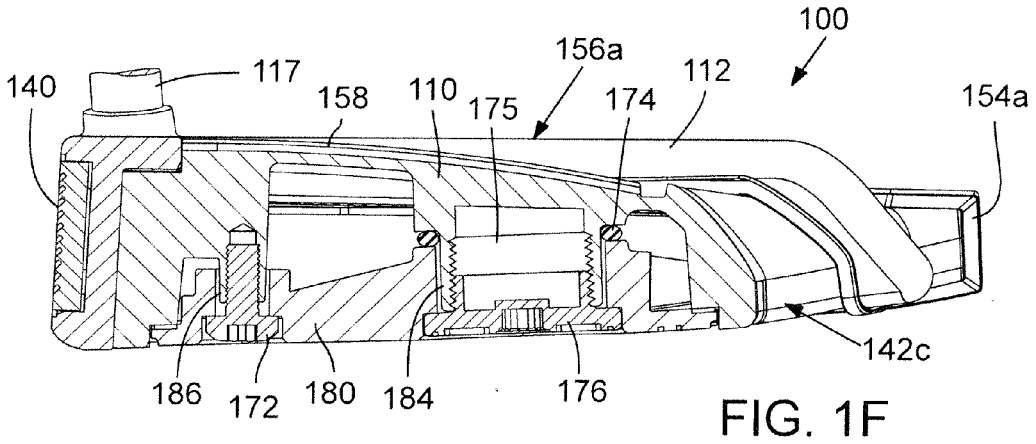
FIG. 1F is a cross section view in elevation of the representative golf club head of FIGS. 1A-1D.

FIG. 1F illustrates a cross-sectional side view taken along a centerline axis of the assembled putter head 100 at a square loft address position to show the interrelationships between the various components as assembled.

Figure 2A:
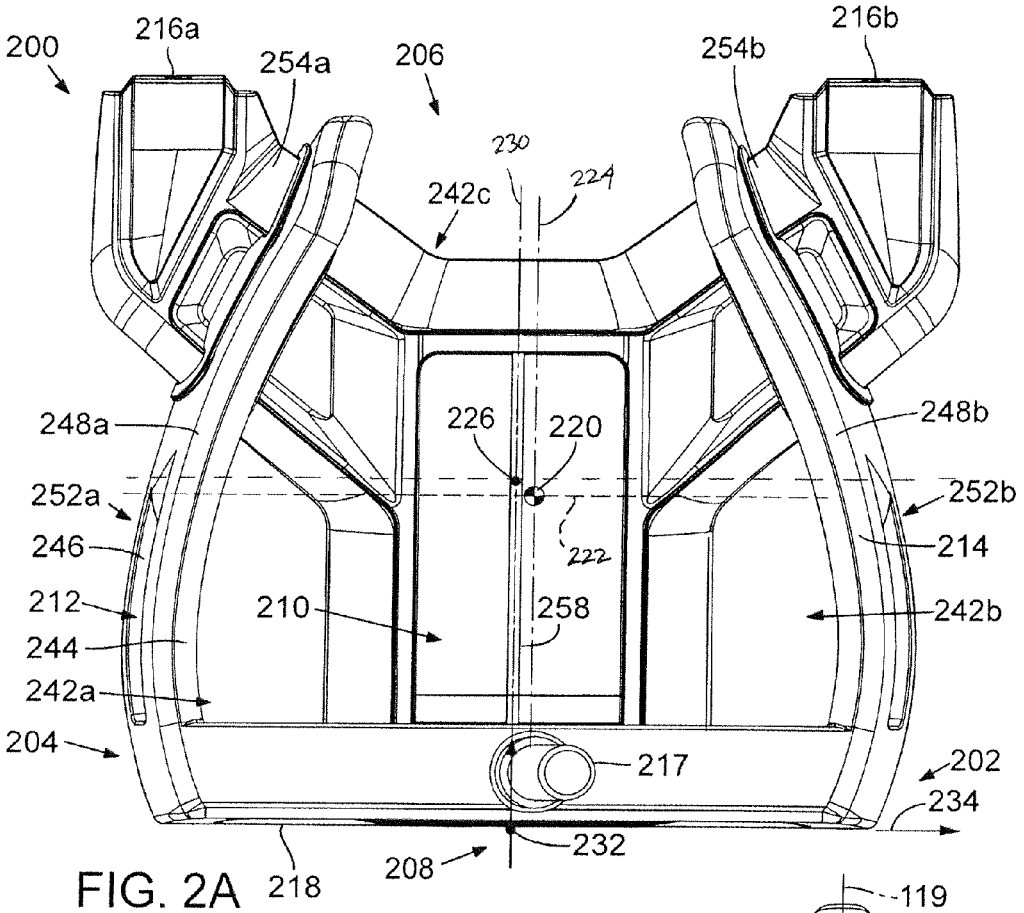
FIGS. 2A, 2B, 2C and 2D are top plan, side elevation, front elevation and bottom plan views, respectively, of another representative golf club head.
Figure 2B:
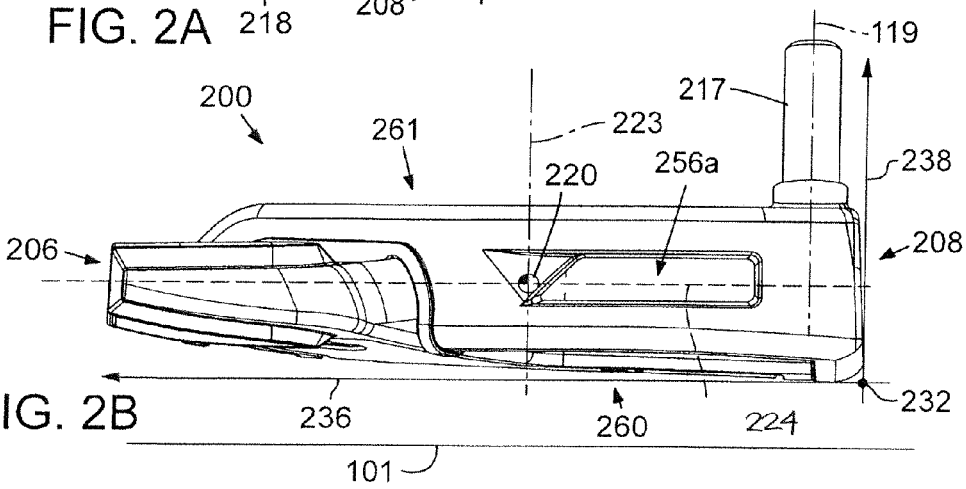
Figure 2C:
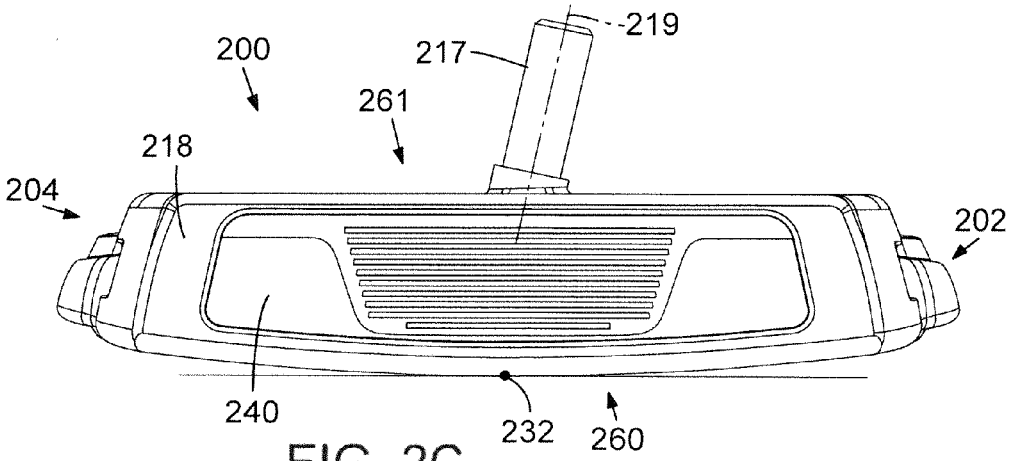
Figure 2D:
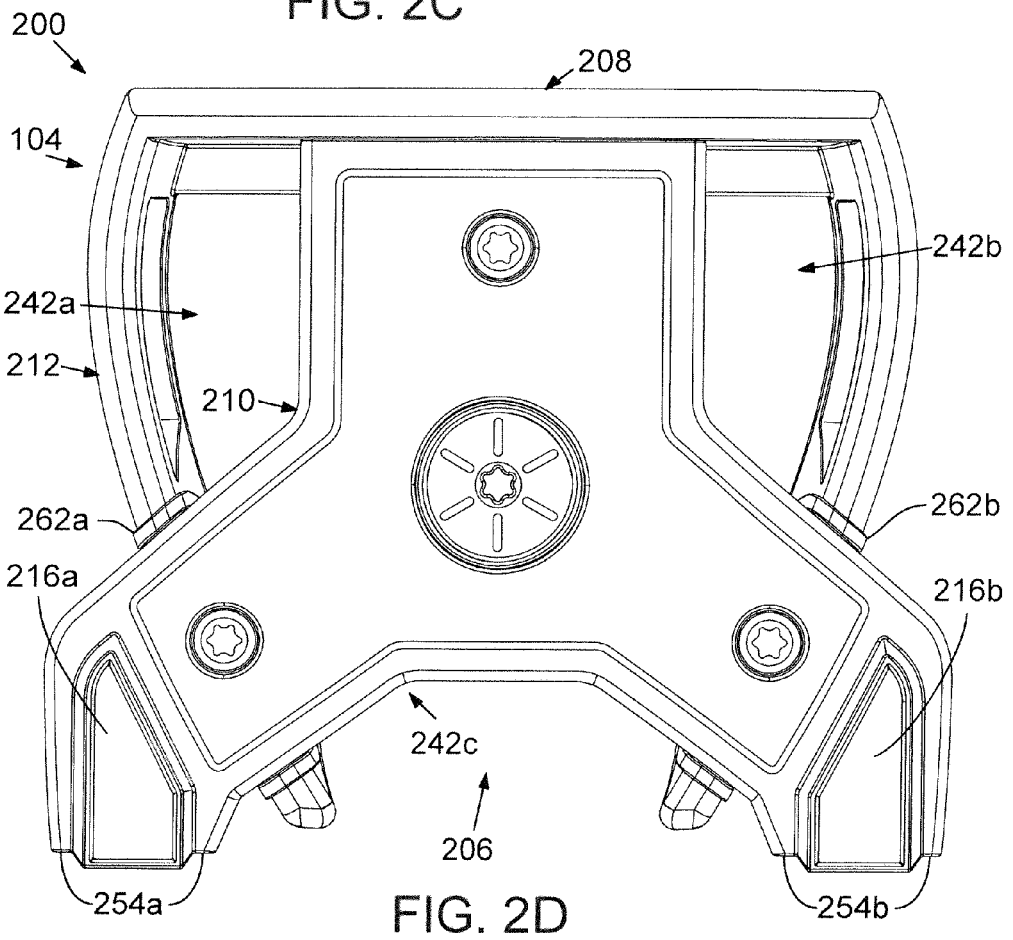
Figure 2E:
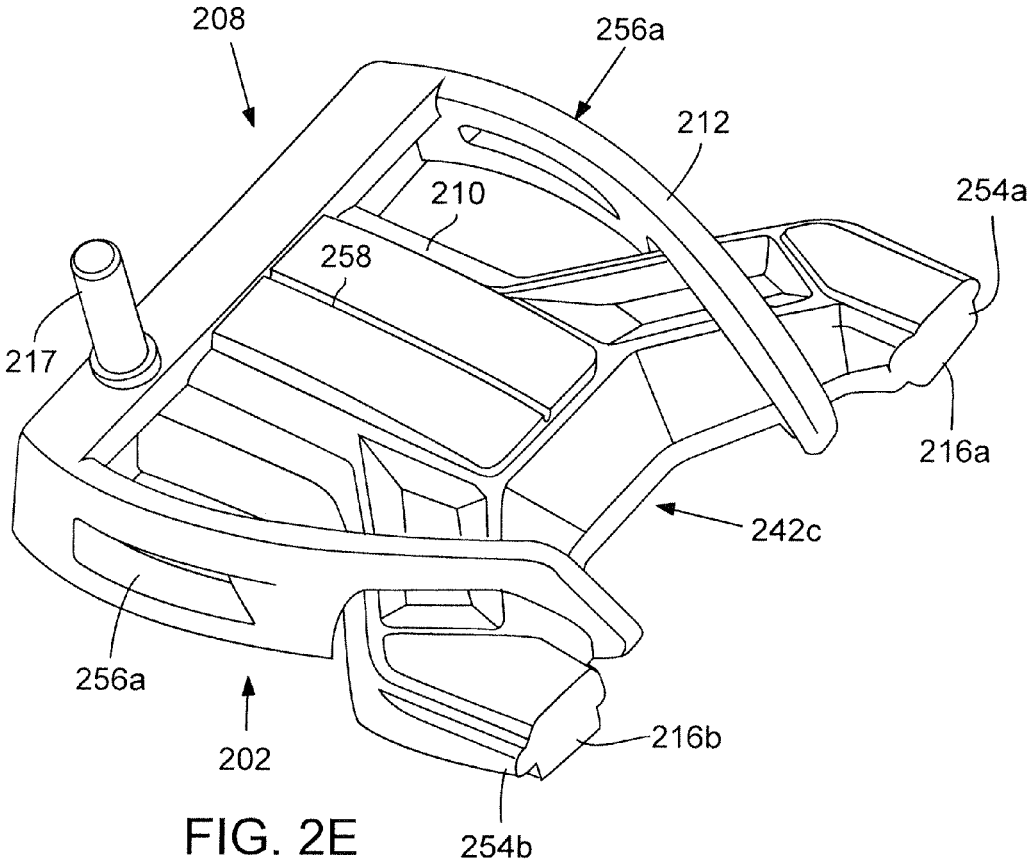
FIG. 2E is a perspective view of the representative golf club head of FIGS. 2A-2D.

FIGS. 2A-2E are various views of a golf club head 200 that is similar in most respects to the golf club 100, except that the hosel 217 is repositioned from a heel position (see, e.g., FIG. 1E) to the more central position as shown in FIG. 2E, as is well suited for a "belly" style putter. In FIGS. 2A-2E, like elements have reference numerals corresponding to those in FIGS. 1A-1E, plus 100. In an exemplary implementation, the golf club head 200 has a CGx of about 0.9 mm (toward the heel), a CGy of about 42.7 mm and a CGz of about 13.2 mm, as well as an $I_{xx}$ value of about 4420 g·cm$^2$ and an $I_{zz}$ value of about 9650 g·cm$^2$.

Figure 3:
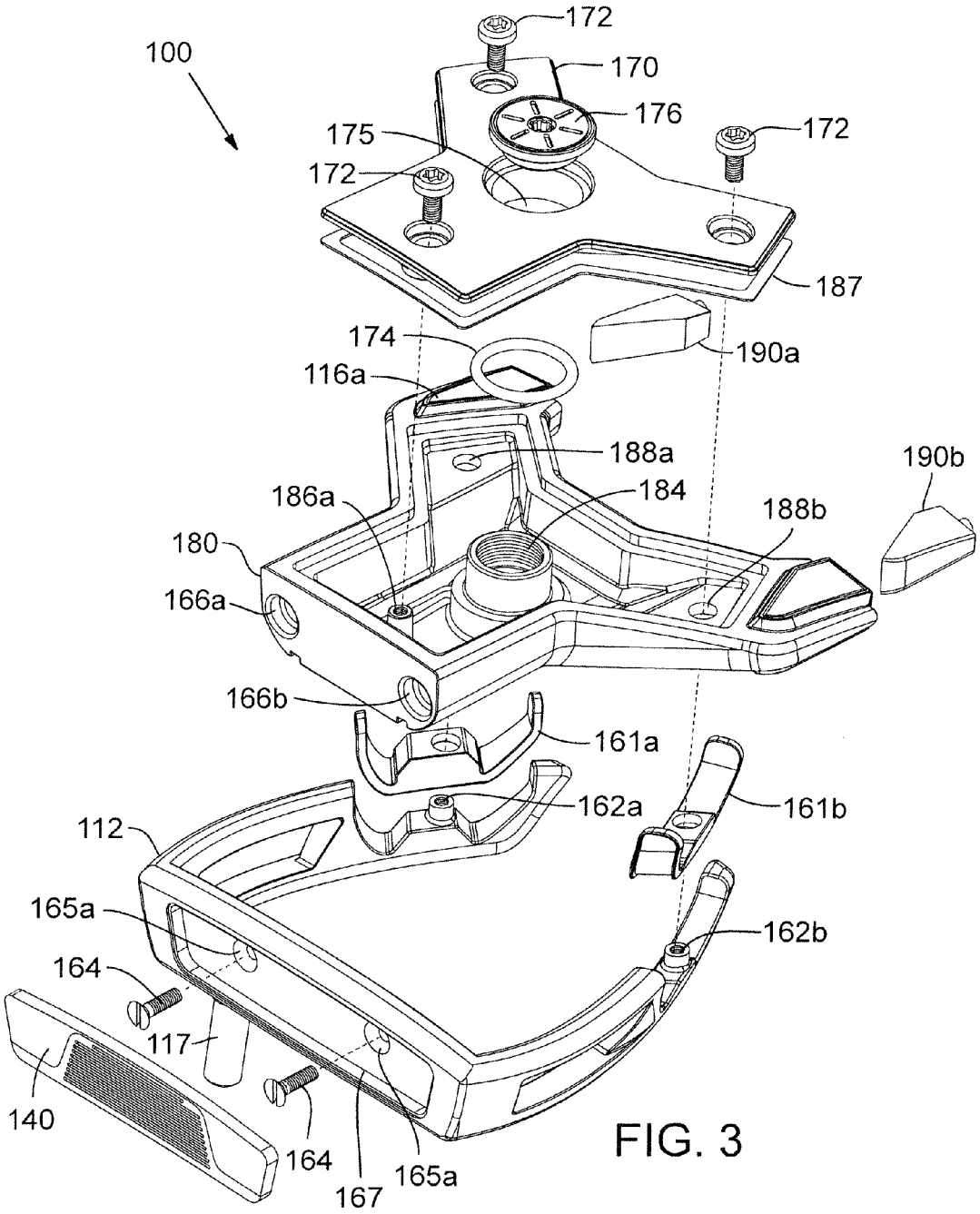
FIG. 3 is an exploded perspective view of the golf club head of FIGS. 1A-1D.

FIG. 3 is an exploded view of a portion of the golf club head 100, with the sole facing upward. For convenience, FIG. 3 is described with reference to the components of the golf club head 100. As can be seen, there is a body 180 that comprises the center portion 110 and the weighted portions 116*a*, 116*b*. In the illustrated implementation, the body 180 defines an internal cavity having a center boss 184 and a threaded boss 186 near the front of the golf club head 100. There are also apertures 188*a* and 188*b*. Weights 190*a*, 190*b* are received within complementary shaped recesses within the weighted portions 116*a*, 116*b*. A contoured sole plate 170 is assembled over the body to cover the recess and is held in place by screws 172 that extend into the boss 186 and through the apertures 188*a*, 188*b*. An 0-ring 174 and die-cut tape 187 provide sealing between the sole plate 170 and the body 180.

The sole plate 170 has a central opening 175 within which a putter weight 176 is received. As described above, in some embodiments the putter weight 176 can range in mass from about 2.5 g to about 25 g. The putter weight can be selected to achieve a desired feel for the golf club.

Two of the screws 172 extend through the apertures 188*a*, 188*b*, through gaskets 161*a*, 161*b* and into threaded bosses 162*a*, 162*b* on the frame 112 to secure the sole plate 170, body 180 and frame 112 together. Additional screws 164 are threaded through apertures 165*a*, 165*b* in the frame and into aligned bosses 166*a*, 166*b* in the body 180. The face plate 140 is received in a recess 167 of the frame 112.

At least one advantage of the embodiments described above is that a lightweight crown portion enables a lower CG and a more desirable effective foot print, actual footprint, inner portion weight ratio, central portion weight ratio, and foot print ratio to be achieved while maintaining a light overall club head weight. In addition, a high MOI can be achieved to reduce club head twisting upon impact.

At least another advantage of the embodiments described above is that more forward roll is promoted and a lower and farther back center of gravity is achieved. An increase in forward roll decreases the possibility of the golf ball skipping or skidding across the ground surface during use.

Another advantage of the embodiments described above, is that a large moment of inertia construction will reduce the amount of twisting that occurs upon impact about the CG X, Y, and Z-axes. The embodiments described herein provide a weight efficient means to achieve a high MOI putter. As described, the $I_{zz}$ can be about 4,000-14,000 g·cm$^2$ as described above in greater detail.

Figure 8:
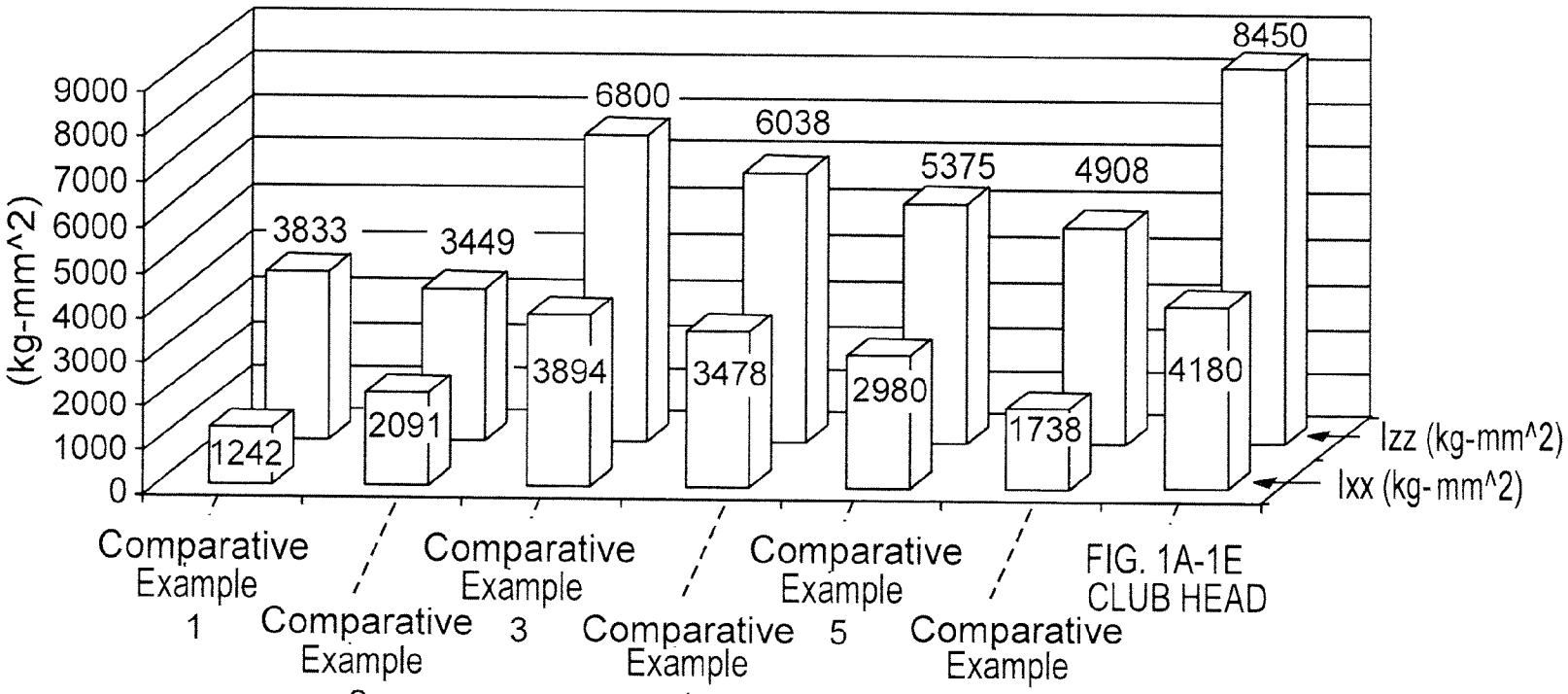
FIG. 8 is a bar graph comparing moments of inertia for the described putter head and for a number of conventional putter heads, for standard size heads.

FIG. 8 is a bar graph showing the moments of inertia for the golf club head of FIGS. 1A-1E compared to a number of comparative example putters. As shown, for the golf club head of FIGS. 1A-1E, the $I_{zz}$ value is about 8450 g·cm$^2$ and the $I_{xx}$ value is about 4180 g·cm$^2$. These values are the highest moments of inertia among the clubs represented in FIG. 8.

Figure 9:
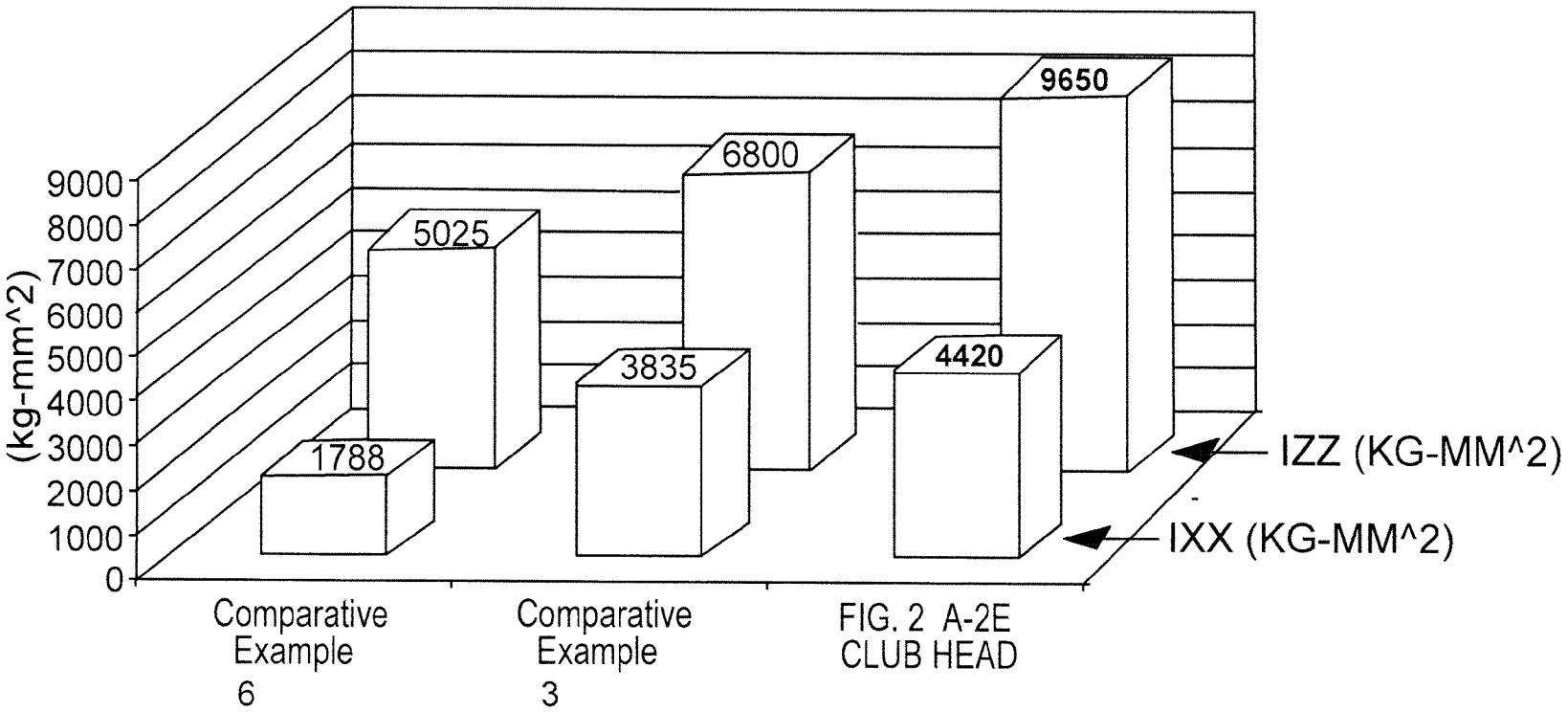
FIG. 9 is a bar graph comparing moments of inertia for the described putter head and for a number of conventional putter heads, for mid-size heads.

FIG. 9 is a bar graph showing moments of inertia for the golf club head of FIGS. 2A-2E compared to two comparative example putters. As shown, the golf club head of FIGS. 2A-2E has an $I_{zz}$ value of about 8500 g·cm$^2$ and an $I_{zz}$ value of about 4150 g·cm$^2$, which are higher moments of inertia than for either of the competitive putter heads.

Figure 10:
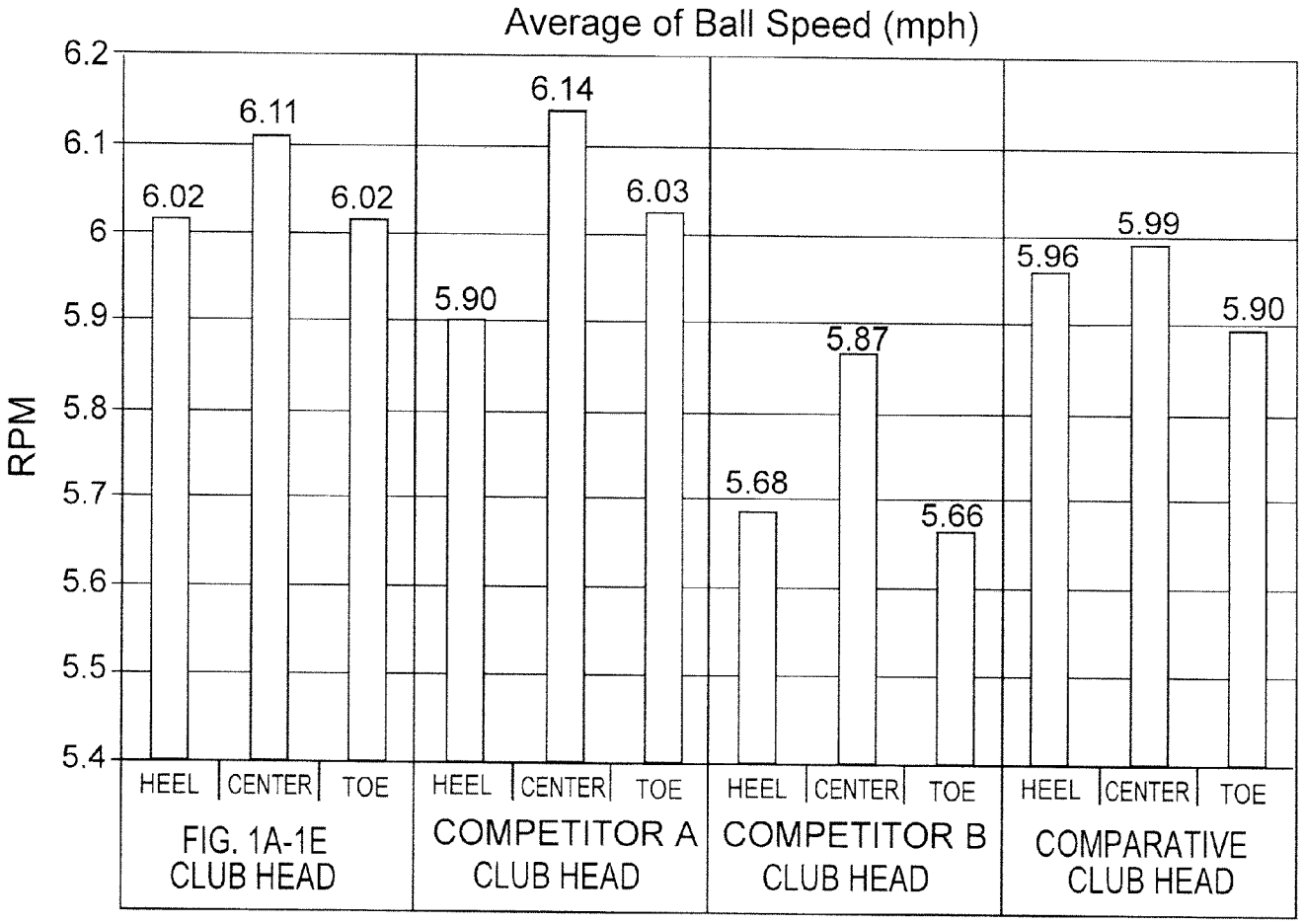
FIG. 10 is a bar graph comparing initial ball speed for the described putter head and a number of conventional putter heads.

FIG. 10 is a bar graph showing that initial ball speed for the FIGS. 1A-1E configuration is consistently high, at the center of the putter head, as well as at the heel end and the toe end of the front face, compared to competitor club heads A, B and C. (For FIGS. 10 and 11, the "heel" is a position 15 mm from center toward the heel, and the "toe" is a position 15 mm toward the toe.) Although the competitor A club head has a slightly higher initial ball speed at the center location than the FIGS. 1A-1E configuration (6.14 mph vs. 6.11 mph), the FIGS. 1A-1E configuration is more consistent and has higher speeds at the heel location (6.02 mph vs. 5.9 mph) and at the toe location (6.02 mph vs. 6.03 mph). Also, the results show that the FIGS. 1A-1E configuration has more symmetrical results (i.e., the speeds for the heel and toe locations are exactly equal) than any other putter that was tested.

Figure 11:
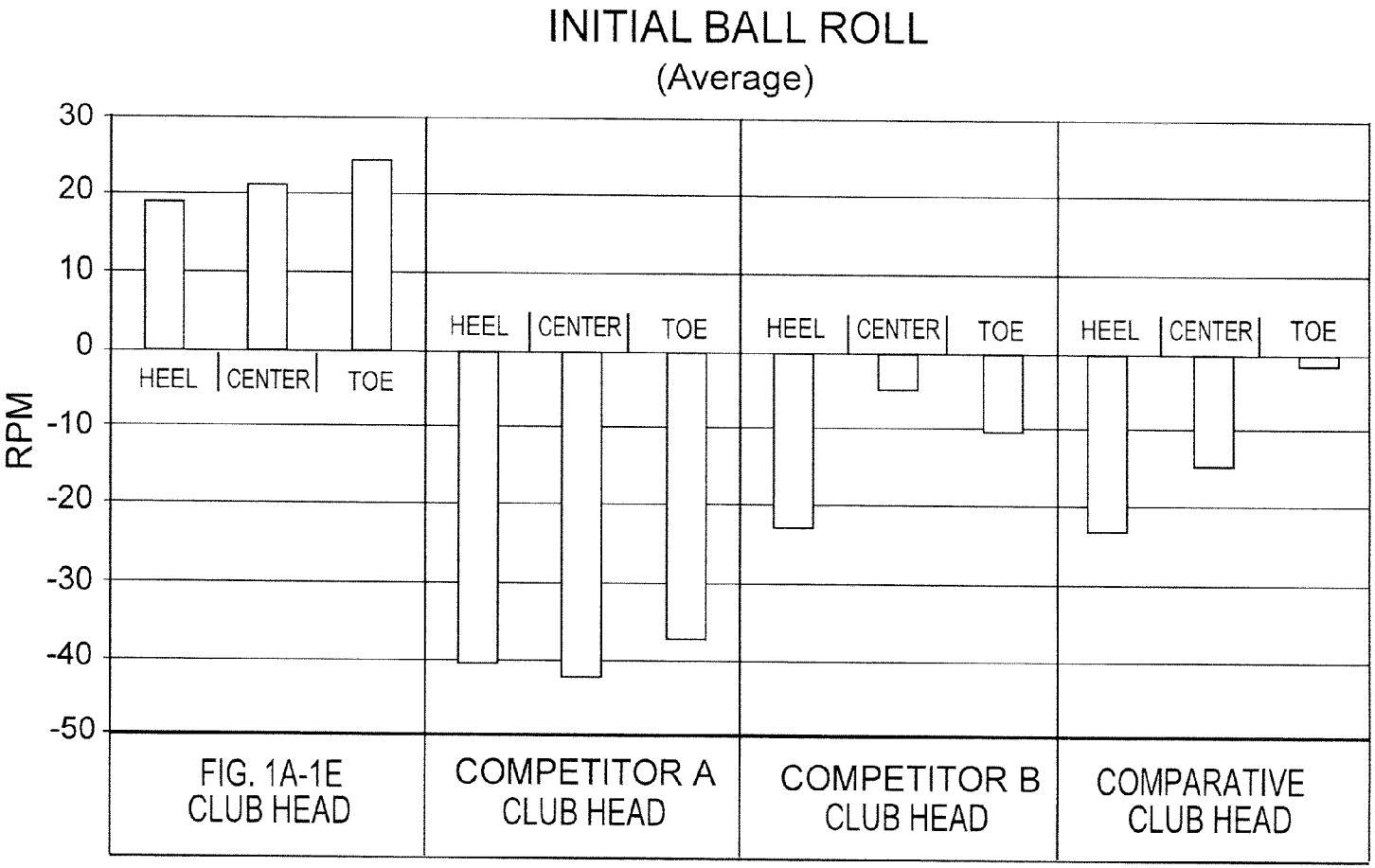
FIG. 11 is a bar graph comparing initial ball roll for the described putter head and a number of conventional putter heads.

FIG. 11 is a bar graph showing the initial ball roll for the FIGS. 1A-1E configuration compared to competitor club heads A, B and C. As shown in FIG. 11, the FIGS. 1A-1E configuration is the only putter head to have positive initial ball roll, with results between about +18 rpm at the heel to +24 rpm at the toe, whereas the results are all negative for the competitor putters. Having a positive initial ball roll means the ball is rolling forward rather than spinning backwards, which is an advantage.

Figure 12A:
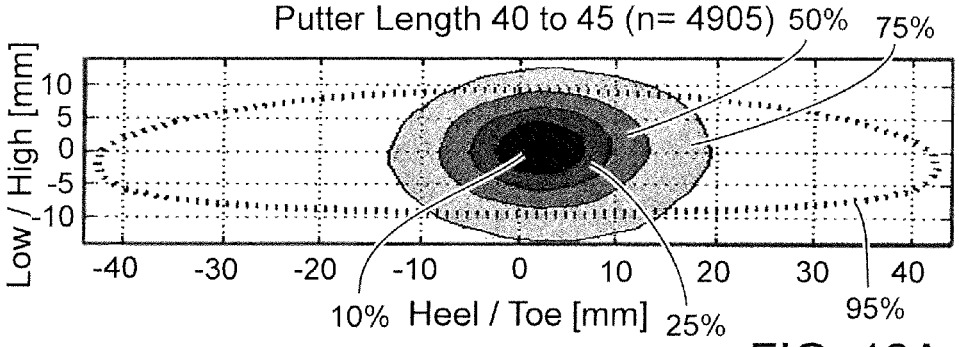
FIG. 12A is a graph of data showing that putter impacts for average golfers using a belly putter are off center.
Figure 12B:
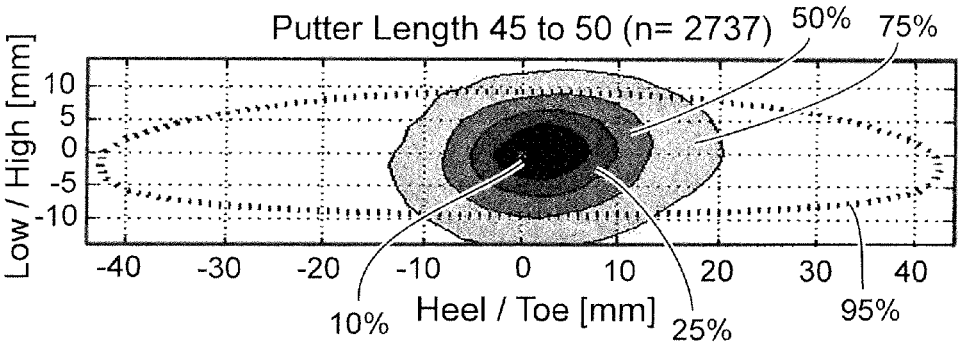
FIG. 12B is a graph of data showing that putter impacts for average golfers using a long putter are off center.

FIGS. 12A and 12B are graphs of player testing data from MATT fitting systems demonstrating that average players do not always hit their putter shots on center. For example, in FIG. 12A average players using a belly length putter on average hit the ball slightly to the toe side of center. Similarly, FIG. 12B shows that average players using a long length putter also hit the ball slightly to the toe side of center on average. Accordingly, a design that recognizes where average players actually hit the ball in their putter shots can improve the results they achieve.

Adjustable Shaft

As stated, it is sometime desirable to change the length of a golf club's shaft. In most cases, the length of a golf shaft is changed in an effort to improve the golf club's fit for the golfer. For example, if a golfer undergoes a professional fitting, it may be recommended that the golfer should lengthen or shorten the shafts of his or her clubs.

Figure 4:
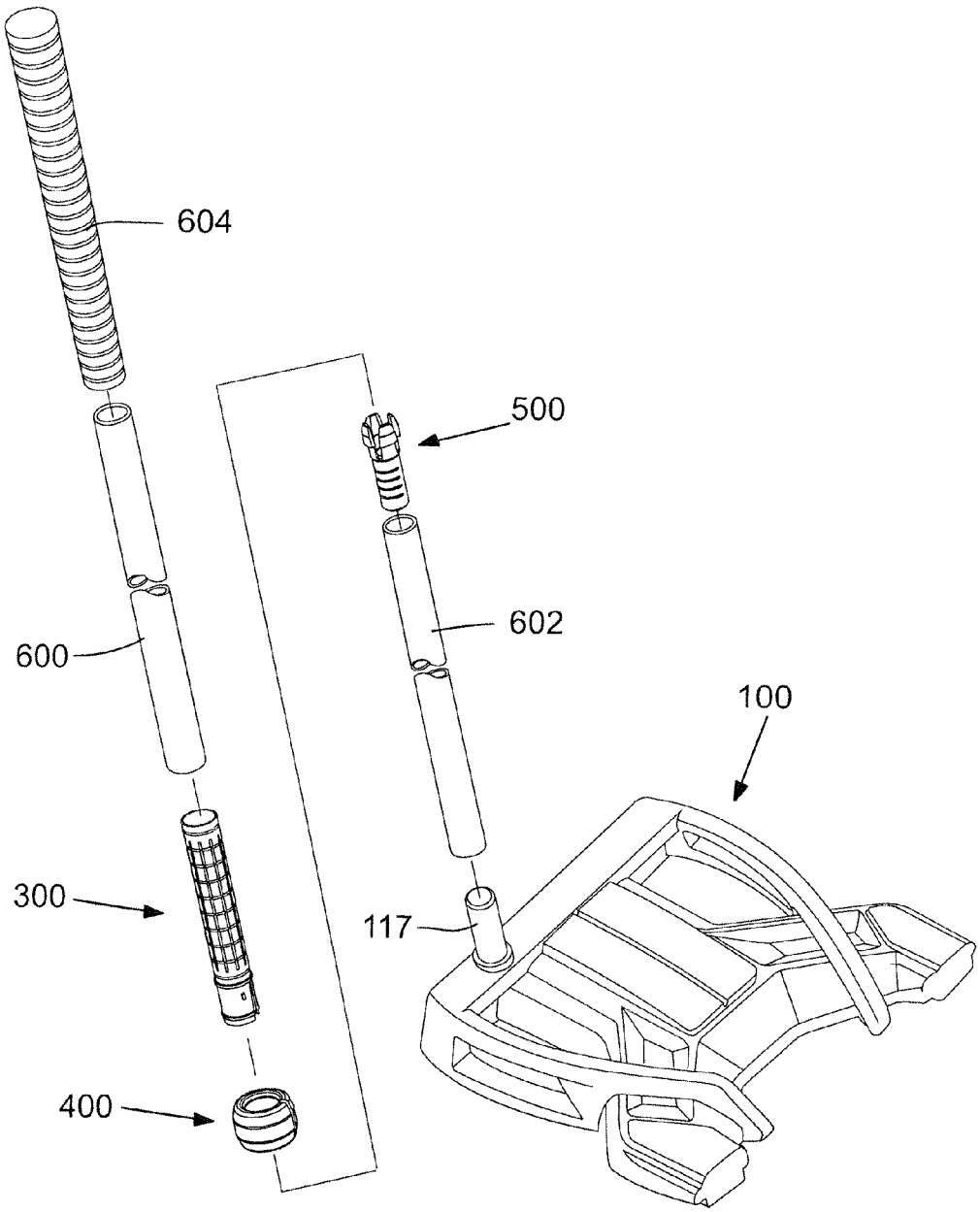
FIG. 4 is an exploded perspective view of a golf club having a golf club head and an adjustable shaft.

FIG. 4 is an exploded perspective view of a golf club 290 with an adjustable shaft according to a one implementation. In the golf club 290, there is an upper shaft section 600 joined to a lower shaft section 602 at a telescoping connection. The lower shaft section is in turn joined to a golf club head, such as the putter head 100.

The telescoping connection according to the illustrated implementation comprises a bushing 300 inserted into an end of the upper shaft section 600, a portion inserted into an end of the lower shaft section 602 (referred to herein as a guide plug 500), and a clamp 400 arranged over the protruding end of the bushing 300 with the guide plug 500 and a length of the lower shaft section 602 received in the upper shaft section 600. A grip 604 is added over the upper end of the upper shaft section to complete the club.

Figure 5A:
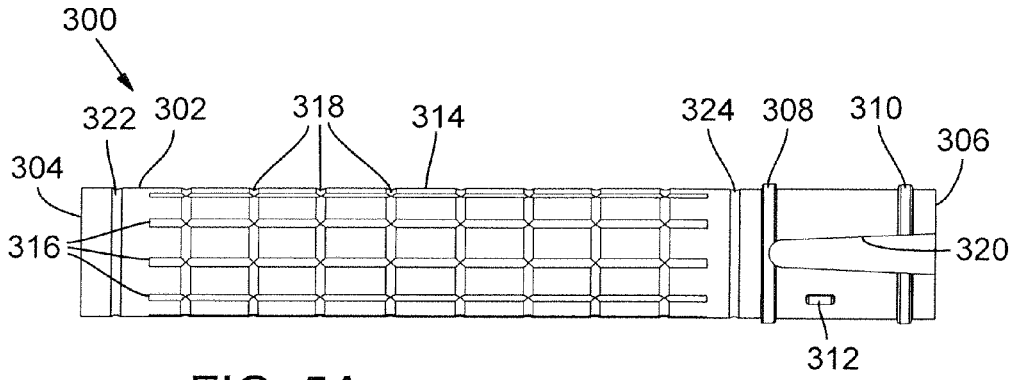
FIGS. 5A, 5B and 5C are top plan, front and section views, respectively, of a bushing as shown in FIG. 4.
Figure 5B:
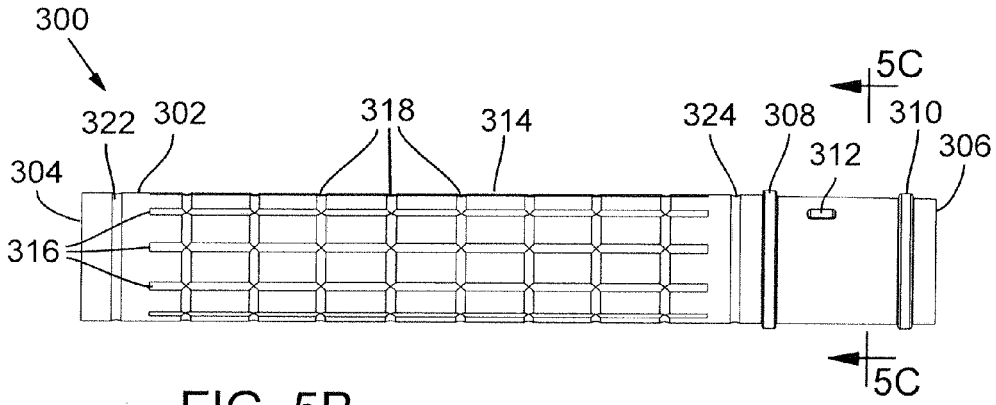
Figure 5C:
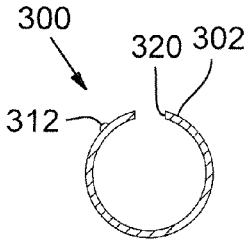

FIGS. 5A, 5B and 5C show the bushing 300 in more detail. The bushing 300 has a first end 304, a second end 306 and a hollow, generally cylindrical body between the ends 304, 306. The first end 304 is inserted into the upper shaft section 600, preferably until the end of the upper shaft section 600 abuts against a stop 308, which is configured as a circumferential rib. Thus, the portion of the bushing 300 from the stop 308 to the second end 306 is designed to protrude from the upper shaft section 600.

The portion of the bushing 300 that is to be inserted can have a textured outer surface 314. For example, the textured outer surface between the first end 304 and the stop 308 can comprise a series of spaced axial grooves 316 and/or a series of spaced circumferential peripheral grooves 318. Additional circumferential grooves 322 and 324 can also be provided. The grooves or other surface texture assist in keeping adhesive in place according to one method of affixing the bushing 300 to the upper shaft section 600. In one implementation, a two-part epoxy, such as 3M® Scotch-Weld™ DP 420 epoxy, is used to secure the bushing 300 and the upper shaft section 600 together.

Spaced slightly inwardly from the second end 306 is a clamp rib 310 configured to receive and guide the clamp 400, as is described in more detail below. There is also a wedge-shaped relief slot 320 extending axially from the second end 306 to the stop 308. The relief slot 320 allows the second end 306 of the bushing 300 to be temporarily compressed so it can be inserted through the clamp 400 during assembly.

There is a retaining rib 312 on the bushing between the stop 308 and the second end 306. The retaining rib 312 is configured as an axially oriented projecting rib, as can be seen more readily in FIG. 5C. The retaining rib 312 cooperates with the structure of the clamp 400 as described below in more detail to prevent the clamp 400 from rotating relative to the bushing 300.

Figure 6A:
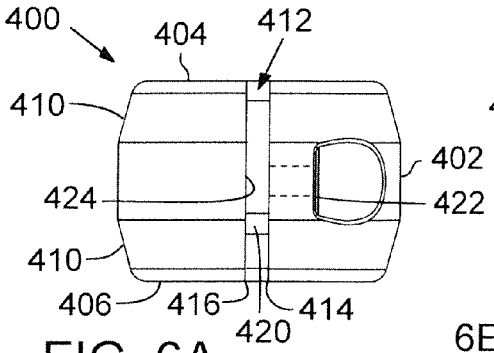
FIGS. 6A, 6B and 6C are front, right side and top plan views of the clamp of FIG. 4.
Figure 6B:
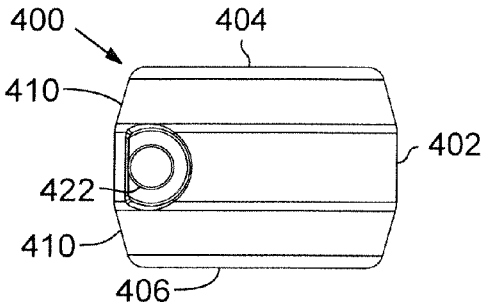
Figure 6C:
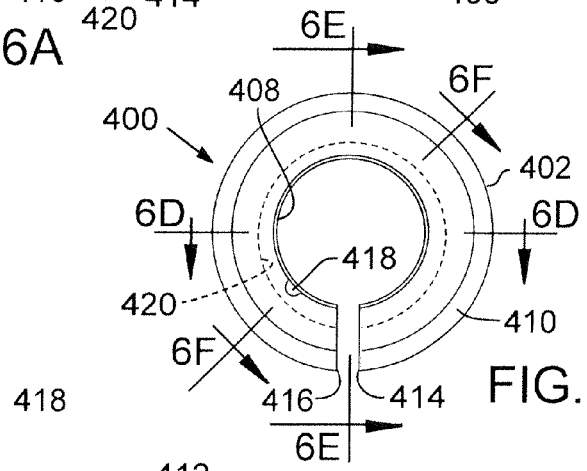
Figure 6D:
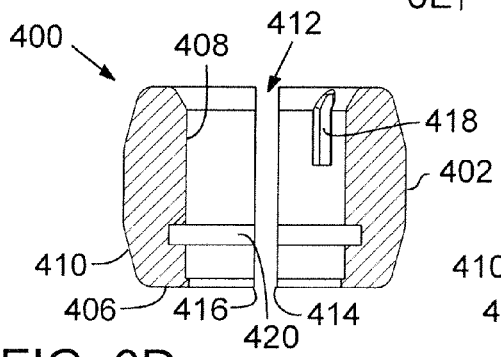
FIGS. 6D, 6E and 6F are section views of the clamp of FIG. 6C.

As shown in FIGS. 6A-6F, the clamp 400 has a generally annular shaped body 402, a first end 404 and a second end 406. A central bore 408 is dimensioned to have a diameter just smaller than the second end 306/protruding section of the bushing 300. As shown in FIG. 6D, the central bore 408 is flared or chamfered at the first end 404 to ease its installation over the second end 306 of the bushing 300. As described below, the clamp 400 can be described as self-locking in that its materials and dimensions are selected such that a sufficient clamping force is generated by the clamp 400 when positioned over the bushing 300 (which is within the upper shaft section 600) with the lower shaft section 602 telescopingly received within the upper shaft section 602. To decrease the clamping force, e.g., to remove the clamp or to adjust the length of the shaft, an axial gap 412 in a body 402 of the clamp is forced apart.

The axial gap 412 is defined between a first edge 414 and a second edge 416. The gap 412 can be increased by forcing the first edge 414 and the second edge 416 away from each other against a spring force exerted by the body 402 of the clamp, such as under action of a threaded end of a tool. A tool as used herein would include a dedicated tool, as well as a threaded bolt driven by a conventional hand tool. The central bore 408 is formed with a circumferential groove 420 shaped to engage the clamp rib 310 of the bushing and to retain the clamp 400 in position in an axial direction relative to the bushing 300, even when the clamp 400 is in a partially unclamped state.

Figure 6E:
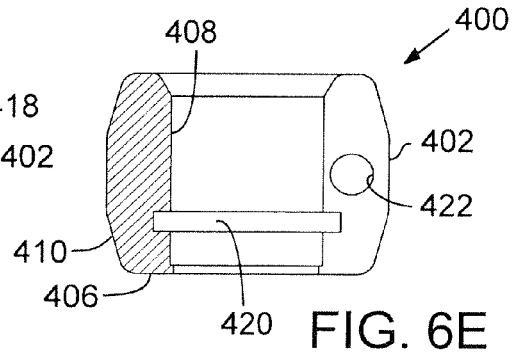
Figure 6F:
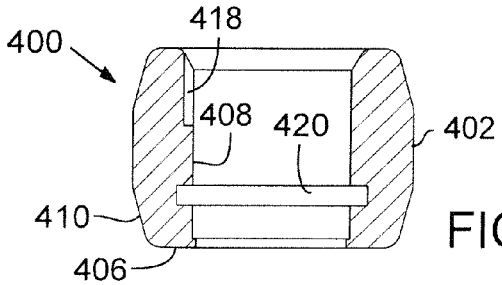
Figure 7B:
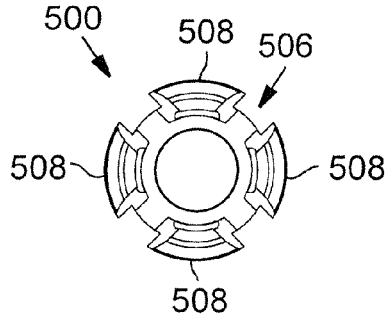
FIGS. 7A and 7B are front and top plan views of the guide plug of FIG. 4.
Figure 7C:
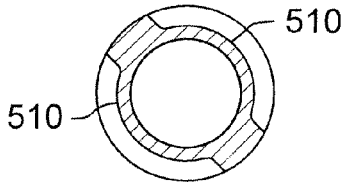
FIGS. 7C and 7D are section views of the guide plug of FIG. 7A.
Figure 7A:
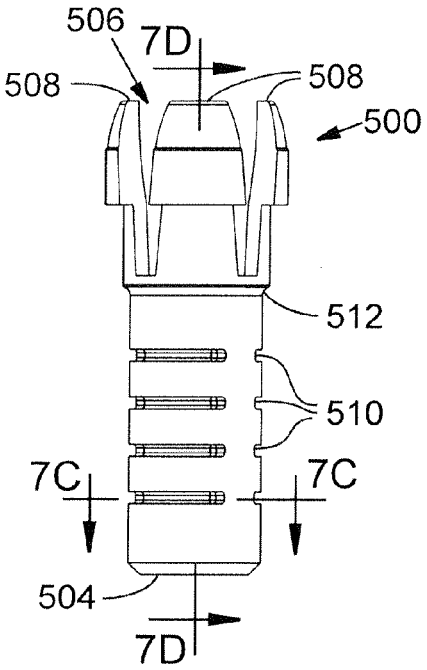
Figure 7D:
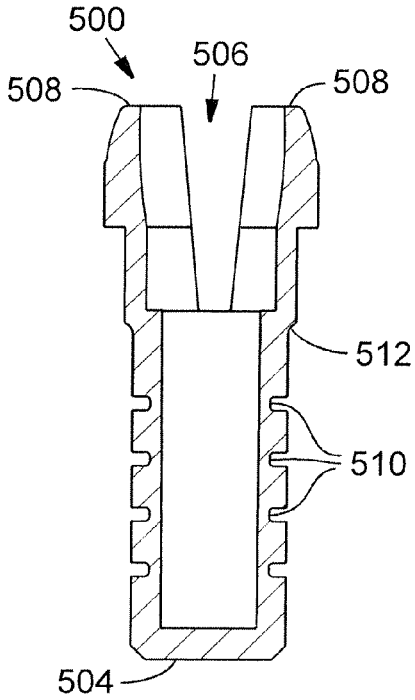

As best shown in FIGS. 6A, 6B and 6E, the body 402 has an aperture 422 defined therein that extends through the first edge 414. The aperture 422 is preferably threaded to receive the threaded end of a tool or the fastener. Once threaded through the aperture 422 and into contact with an opposite surface 424 on the other side of the gap 412, further rotation of the threaded tool or fastener tends to urge the first edge 414 and the second edge away from each other. Once the clamping force is sufficiently decreased, the shaft sections 600, 602 can be positioned as desired, and the threaded tool or fastener can then be rotated in the opposite direction to allow the clamp 400 to return to its normal clamping position, thus securing the assembly together.

In some implementations, the bore 424 is configured with a left-hand thread for use with a tool or fastener having a corresponding left-hand thread. In these implementations, there is an advantage that users learn to operate the mechanism more readily because a counter-clockwise rotation with a left-hand thread assembly results in loosening the clamp 400 (i.e., causing the gap 412 to increase), which follows the "turn left to loosen" approach that is intuitive for most people to attempt first.

The clamp 400 also has an axial groove 418 that is dimensioned to receive the retaining rib 312 of the bushing 300 as the clamp 400 is slid over the second end 306. Engagement between the retaining rib 312 and the axial grove 418 prevents the clamp 400 from rotating relative to the bushing 300. The clamp can be formed of a stainless steel or another suitable material. In specific embodiments, a heat treated stainless steel such as 17-4H900 HRC 42-46 is used.

FIGS. 7A-7D show the guide plug 500 in more detail. The guide plug 500 has a body 502, a first end 504 and a second end 506. The first end 504 is dimensioned for insertion into a lower shaft section 602. Specifically, the first end 504 is inserted into the shaft section 602 until a stop 512, which is shaped as a circumferential rib, abuts against an end of the shaft section. Between the first end 504 and the stop 512, there are grooves 510 or another suitable surface pattern for retaining adhesive to secure the guide plug 500 and the shaft section 602 together.

At the second end 506, there are one more resilient elements that serve as retainers. In the illustrated implementation, there are four protruding ears 508. These ears 508 are dimensioned and shaped to resiliently deform, allowing the second end 506 to be guided into the bore of the bushing 300/upper shaft section 600 during assembly. The clamp 400 can then be tightened over the protruding portion of the bushing 300 with the relief slot 320 to allow the bushing to engage the lower shaft section 602 extending within it. When the clamp 400 is in a fully loosened state, engagement of the protruding ears 508 against the inner surface of the upper shaft section 602 and or the bushing 300 prevents the shaft sections 600, 602 from simply sliding apart from each other. Instead, a deliberate positive force must be applied to move the shaft sections 600, 602 relative to each other.

In the above description, the bushing 300 is secured to the upper shaft section 600 and the guide plug 500 is secured to the lower shaft section 602. It would also be possible to have the lower shaft section 602 telescopingly coupled to the upper shaft section 600 with the upper shaft section 600 positioned within the lower shaft section 602, the guide plug attached to the upper shaft section 600 and the bushing attached to the lower shaft section 602.

In some implementations, the bushing 300 and the guide plug 500 are formed of a nylon material, such as 30% glass-filled nylon 6/6. It would also be possible to form the components from a polyoxymethylene material, such as DELRIN.

Materials

The components of the above described components disclosed in the present specification can be formed from any of various suitable metals, metal alloys, polymers, composites, or various combinations thereof.

In addition to those noted above, some examples of metals and metal alloys that can be used to form the components of the connection assemblies include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the components include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®).

Whereas the invention has been described in connection with representative embodiments, it will be understood that the invention is not limited to those embodiments. On the contrary, the invention is intended to encompass all modifications, alternatives, and equivalents as may fall within the spirit and scope of the invention, as defined by the appended claims.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. A golf club head, comprising:

a front portion, a rear portion, a toe portion, and a heel portion together forming a two-piece body and for which a center of gravity is defined, the body comprising a central portion as a first piece, and a frame as a second piece, the frame enclosing a substantial portion of the central portion within an XY-plane, wherein the central portion is connected with the frame with fasteners along at least the front portion, wherein the moment of inertia of the club head about a z-axis of the center of gravity is between about 7,000 $g \cdot cm^2$ and about 14,000 $g \cdot cm^2$;

further comprising a sole plate located within the central portion and attached to the central portion with fasteners.

2. The golf club head of claim 1, wherein the moment of inertia of the club head about the z-axis of the center of gravity is between about 7,000 $g \cdot cm^2$ and about 10,000 $g \cdot cm^2$.

3. The golf club head of claim 1, wherein the moment of inertia of the club head about the z-axis of the center of gravity is between about 7,000 $g \cdot cm^2$ and about 9,500 $g \cdot cm^2$.

4. The golf club head of claim 1, wherein the moment of inertia of the club head about the z-axis of the center of gravity is between about 8,200 $g \cdot cm^2$ and about 9,500 $g \cdot cm^2$.

5. The golf club head of claim 1, wherein the sole plate is comprised of an injection molded material.

6. The golf club head of claim 1, wherein the sole plate comprises a centrally located opening shaped to receive a weight threadedly connectable to the central portion.

7. The golf club head of claim 1, wherein the fasteners attaching the central portion to the frame along the front portion extend in a first direction, further comprising fasteners extending in a second direction adjacent a rear of the frame attaching the central portion to the frame.

8. The golf club head of claim 1, further comprising a hosel extending from the body and a length-adjustable shaft connected to the hosel.

9. An adjustable golf club, comprising:

a golf club head comprising a front portion, a rear portion, a toe portion, and a heel portion together forming a two-piece body and for which a center of gravity is defined, the body comprising:

a central portion as a first piece, and a frame as a second piece, the frame enclosing a substantial portion of the central portion within an XY-plane, wherein the central portion is connected with the frame with fasteners along at least the front portion;

the golf club head further comprising a sole plate located within the central portion and attached to the central portion with fasteners; and a telescoping shaft connected to the frame, wherein the shaft is adjustable in length;

wherein the moment of inertia of the golf club head about a z-axis of the center of gravity of the golf club head is between about 7,000 $g \cdot cm^2$ and about 14,000 $g \cdot cm^2$.

10. The adjustable golf club of claim 9, wherein the sole plate is comprised of an injection molded material.

11. The adjustable golf club of claim 9, wherein the sole plate comprises a centrally located opening shaped to receive a weight threadedly connectable to the central portion.

12. The adjustable golf club of claim 9, wherein the fasteners attaching the central portion to the frame along the front portion extend in a first direction, the golf club head further comprising fasteners extending in a second direction adjacent a rear of the frame attaching the central portion to the frame.

13. The adjustable golf club of claim 9, wherein the telescoping shaft comprises:

a lower shaft section having a first end for connection to the golf club head and an opposite second end;

an upper shaft section dimensioned to telescopingly receive the second end of the lower shaft section;

a deformable retainer connected to the second end of the lower shaft section; and a clamp positionable at the intersection of the upper shaft section and the lower shaft section, the clamp being adjustable to secure the upper shaft section and the lower shaft sections together to achieve a selected overall shaft length, wherein the retainer is configured to contact an inner surface of the upper shaft section to prevent the lower shaft section and the upper shaft section from inadvertent disassembly if the clamp is in a loosened state.

14. The adjustable golf club of claim 13, further comprising a bushing inserted in the upper shaft section and through which the lower shaft section is received, wherein the bushing and the clamp having mating engagement surfaces to position the clamp relative to the bushing and the shaft sections.

15. The adjustable golf club of claim 14, wherein the engagement surfaces include a circumferential rib on the bushing and a circumferential groove on the clamp dimensioned to receive the circumferential rib.

16. The adjustable golf club of claim 14, wherein the engagement surfaces include an axial rib on the bushing and an axial groove on the clamp dimensioned to receive the axial rib.

17. The adjustable golf club of claim 14, further comprising a guide plug dimensioned for insertion into the lower shaft section and having a protruding section that comprises the retainer.

18. The adjustable golf club of claim 17, wherein the retainer comprises resiliently deformable ears shaped to bend and guide the lower shaft section upon its insertion through the bushing and into the upper shaft section, and wherein the lower shaft section cannot be withdrawn from the upper shaft section without permanently deforming the retainer.

19. The adjustable golf club of claim 13, wherein the clamp is annular-shaped and comprises an axially-extending gap and a threaded aperture on one side of the gap into which a threaded tool can be rotated into contact with a surface on an opposite side of the gap to widen the gap and loosen the clamp from its self-locking state.

20. The adjustable golf club of claim 13, wherein the clamp is self-locking and formed of a heat treated stainless steel selected to apply a desired clamping force to the bushing and the lower shaft when the clamp is at rest.

* * * * *